US006901727B2

(12) United States Patent
Müller

(10) Patent No.: US 6,901,727 B2
(45) Date of Patent: Jun. 7, 2005

(54) DEVICE FOR STRAPPING

(75) Inventor: Erwin Müller, Dürnten (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/683,309

(22) Filed: Oct. 10, 2003

(65) Prior Publication Data

US 2004/0163366 A1 Aug. 26, 2004

Related U.S. Application Data

(63) Continuation of application No. 09/992,189, filed on Nov. 16, 2001, now abandoned.

(30) Foreign Application Priority Data

Nov. 20, 2000 (CH) ..... 2259/00

(51) Int. Cl.[7] ..... B65B 13/04

(52) U.S. Cl. ..... 53/589; 53/399; 53/419; 53/580; 53/582

(58) Field of Search ..... 53/589, 586, 399, 53/397, 419, 580, 582

(56) References Cited

U.S. PATENT DOCUMENTS 3,977,314 A * 8/1976 Tanaka
4,062,278 A * 12/1977 Cheung
4,079,667 A * 3/1978 Lems et al.
4,378,262 A * 3/1983 Annis, Jr.
RE31,353 E * 8/1983 Cheung
4,534,817 A * 8/1985 O'Sullivan
4,836,873 A * 6/1989 Mitanihara et al.
4,850,180 A * 7/1989 Takami
5,121,682 A * 6/1992 Parker et al.
5,275,674 A * 1/1994 Sayyadi
5,373,686 A * 12/1994 Lang et al.
5,425,826 A * 6/1995 Sayyadi et al.

FOREIGN PATENT DOCUMENTS

CH 447 007 * 11/1967
DE 41 00 276 A1 * 7/1991
DE 42 30 730 A1 * 3/1994
EP 0 725 005 A1 * 1/1996
EP 0 905 025 A1 * 9/1997

* cited by examiner

*Primary Examiner*—Louis K. Huynh
*Assistant Examiner*—Christopher Harmon
(74) *Attorney, Agent, or Firm*—Rankin, Hill, Porter & Clark LLP

(57) ABSTRACT

A strapping device (1) for strapping an object (14) with a strapping tape (5). The strapping device (1) includes a guide (3) for guiding a strapping tape (5), which serves for the purpose of forming a loop of strapping tape (5) in a waiting position. The formation of the loop takes place independently of the position of the object to be strapped (14). The strapping device (1) furthermore comprises a device for moving the loop (4). This device serves to position the loop of strapping tape (5) formed by the guide (3) from the waiting position into a stacking position around an object (14) to be strapped, after this object has been positioned on a work surface (2).

20 Claims, 3 Drawing Sheets

DEVICE FOR STRAPPING

This application is a continuation of application Ser. No. 09/992,189, filed Nov. 16, 2001, now abandoned.

BACKGROUND OF THE INVENTION

1. Field of the Invention

The invention is related to a device for the strapping with a strapping tape of an essentially cube-shaped or cuboid object and, more particularly, a stack of printed products.

2. Description of Related Art

Known from prior art are various devices, which serve for the strapping of stacks of printed products by means of strapping, particularly a strapping tape. In the case of these devices, a stack of printed products to be strapped is brought to a strapping device by a feeding device, where one or more strapping tapes are laid around the stack. After the strapping, the strapped stack is conducted away from the work zone. Plastic tapes made from polyethyleneterephthalate or polypropylene, for example, are most commonly used.

Strapping means are primarily laid around a stack, (i.e., around a cube-shaped (cuboid) device) in two directions: in the direction of conveyance (longitudinal strapping), in which the stack brought into the work zone, and transverse to the conveyance direction (transverse strapping). While the devices known from prior art can cope with strapping in the transverse direction, strapping in the longitudinal direction with the same devices is, in most cases, associated with certain problems. As a result of the principles involved, parts of the machine are arranged in a manner that interferes with the longitudinal strapping.

From DE 41 00 276 a device is known that comprises a curved, longitudinally slotted channel that is arranged at an angle above and adjacent to a stack of printed products to be strapped. A strapping tape is introduced into the channel, in order to thereupon be laterally pulled out of the channel. Until the tape finally has been laid around a stack to be strapped, it first has to slide over an inclined surface and then has to overcome, at an angle, a free stretch in the air. This arrangement encompasses certain uncertainties because, as a result of the inclined trajectory, it is only poorly possible to determine where the tape will come to lie.

From DE 42 30 730 a further device is known that comprises a static and a movable tape guide channel. This channel is arranged at an oblique angle to a feeding device. In order to be in a position to rationally strap a stack of printed products it is necessary to align it at a corresponding angle relative to the channel.

From EP 0 725 005 a device is known in which a strapping tape is conveyed across a free stretch of air by means of air pressure. This device has the disadvantage that a secure conveyance of the strapping tape across the free stretch of air can only be guaranteed with difficulty. Apart from this, it is only possible to form the tape into a loop after a stack to be strapped has reached a work zone.

SUMMARY OF THE INVENTION

It is an objective of the invention presented here to demonstrate a strapping device that avoids the disadvantages known from prior art. The device is to make it possible to rapidly strap objects in a longitudinal and/or transverse direction in a simple manner.

The present invention is preferably suitable for the strapping of printed products and other objects. The strapped items can have differing dimensions and positions. The invention is in particular distinguished by a rapid processing and a high flexibility, because the strapping loop can be prepared independent of the position of the stack to be strapped. Because of only a small number of fast moving parts, an optimized cycle is achieved. The invention is particularly suitable for a strapping both in the longitudinal and transverse directions.

The invention is based on the fact that a means of strapping, in particular a strapping tape, which is to be laid around a stack of printed products, is prepared by means of a suitable loop forming device in a waiting position, independent of and free of (uninfluenced by 90°) the momentary position of the stack to be strapped, i.e., is formed into a loop. This prepared loop thereupon, as soon as the stack to be strapped has reached a strapping position, by means of a loop movement device by turning (e.g., folding over by) and/or by lateral displacement is brought into a stacking position from the waiting position, in which it encircles the stack at a certain distance, in preference centrally. Subsequently, the loop, starting out from the stacking position, is laid around the stack, tightened and locked so as to form a strapping.

The invention can be designed such that the loop forming device is a groove embedded in a horizontal work surface, which serves as guide track or guide means for the strapping device. Into this groove the means of strapping is introduced or inserted in a longitudinal direction and formed into a loop (loop in waiting position). In doing so, the groove is designed such that the loop does not protrude from the groove and so does not have an obstructive effect. As soon as the stack to be strapped has reached a strapping position, the loop present in the groove in the waiting position is raised away from the work surface into an upright position by means of the loop forming device (e.g., by rotation around a point) such that the loop comes to lie above and lateral to the stack to be strapped. The loop is now in the stacking position.

The loop movement device, for example, comprises one or more straight or curved arms arranged as fixed or movable, along which grippers are located, which can be displaced under control. The grippers are designed such that they are in a position to bring the means of strapping (strapping tape) from the waiting position into the stacking position. For example, the grippers, depending on the field of application, can have an open or closed, single or multipart construction. Preferably, the grippers are of lightweight construction to facilitate rapid displacement.

Particularly suitable as drive for the loop movement means, resp., for the grippers, are recirculating traction elements, air pressure (compressed air), hydraulic systems, solenoid or piezo-electric drives. The one or more loop movement means advantageously are designed such that movement of the grippers along the arms and the position of the arms, resp., their relative course, is adjustable. As a result of this, objects of the most differing size (height, width, length and shape) can be processed. Because of the flexible design, it is possible to influence the loop even while it is brought from the waiting position to the stacking position, in that, for example, the arms are moved relative to one another. This has the effect of specifically enlarging the loop or reducing the loop. The stack can assume differing strapping positions.

In the stacking position, the loop is bigger than the circumference of the stack to be strapped such that the loop encircles the stack at a certain distance. Starting out from the stacking position, the loop is separated from the loop movement device, i.e., from the one or more grippers, and drawn together such that the strapping means tightly girdles the stack to be strapped. Subsequently, the means of strapping is tied down and closed to form a strapping.

BRIEF DESCRIPTION OF THE DRAWINGS

These and further features of the invention will be apparent with reference to the following description and drawings, wherein.

DETAILED DESCRIPTION OF THE PREFERRED EMBODIMENT

Figure 1:
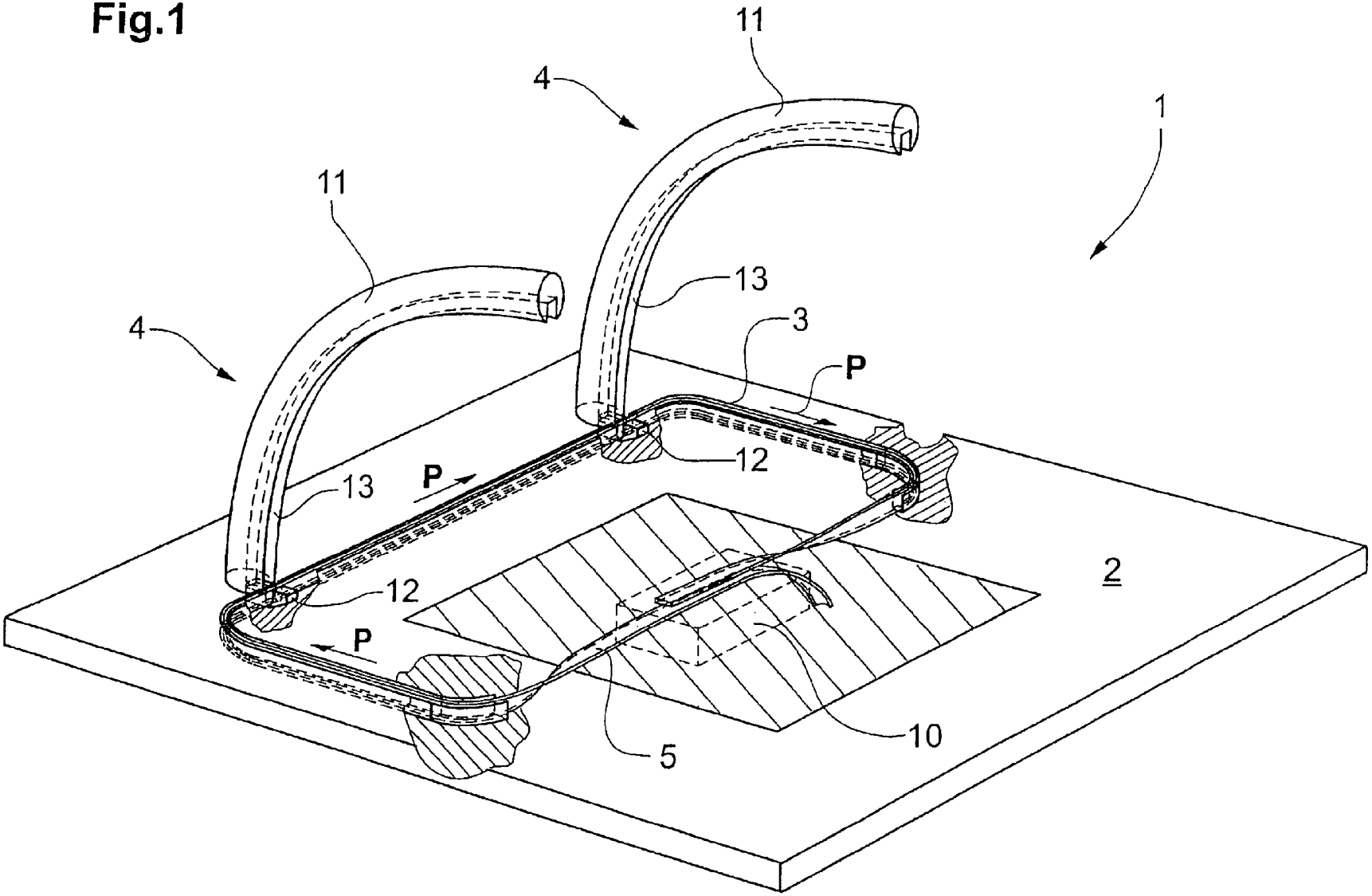
FIG. 1 is a preferred embodiment of a device in accordance with the invention with a loop of a strapping tape.

FIG. 1 schematically and in a strongly simplified way illustrates a strapping device 1 in accordance with the invention. The strapping device 1 includes a work surface 2, a groove 3 embedded in the work surface and two loop movement devices 4. The groove 3 embedded in the work surface 2 runs essentially along the edges of a rectangle and serves as means of guidance (guide channel) for guiding a strapping means, in this case the strapping tape 5. The groove 3 is designed such that the strapping tape 5 can be introduced into the groove, by being pushed into the groove in the direction of the arrow P, either actively or passively, from a supply magazine, for example, from a supply roll, which is located underneath the work surface 2. If so required, additional tape feeding means (not depicted in more detail), for example, in the form of tape feed rolls (not depicted in more detail) are present, which assist in the introduction of the strapping tape 5 into the groove 3. The depth of the groove 3 is selected such that the strapping tape 5 introduced into the groove does not protrude from the groove 3. Additional elastic elements (not illustrated in more detail), such as lamella or bristles, close off the groove 3 against the work surface 2 so that the strapping tape 5 is secured against inadvertently coming out of the groove 3 and so that the danger of contamination with dirt of the groove 3 is reduced. The groove 3 can also be closed-off during the introduction of the strapping tape 5 by means of a rigid element (not illustrated in more detail).

Also located underneath the work surface 2 are known tightening and cutting devices (not depicted in more detail) for tightening and severing the strapping tape 5. A closing device 10 serves to tightly close the strapping tape 5 to form a ring, which tightly encircles the stack of printed products (refer to FIG. 2). The closing device, for example is an ultrasonic welding device, which is located in the zone of the work surface 2. It goes without saying, that other devices can be utilized for closing and cutting off the strapping tape 5.

In the illustrated embodiment, the two loop movement means 4 each respectively comprise one arm 11 that protrudes from the work surface 2 in the zone of the groove. The curved arms 11 essentially run parallel to and extend over the work surface in an arc to permit the stack to be strapped (refer to FIG. 2) to be moved under them or across between them. Along each one of the arms 11, a gripper 12 is arranged to be displaceable under control in a guide groove 13. The grippers 12 in the illustrated waiting position project into the groove 3 and are designed such that they temporarily take hold of the strapping tape 5 as soon as it has been introduced into the groove 3 to form a loop, and thereupon are able to raise it away from the work surface into an upright position shown in FIG. 2.

The arms 11 can either be arranged to be movable or else can have a variable geometry so that their position relative to the work surface 2, their lateral distance and course can be changed or adapted. As a result of this, it is possible to strap stacks of the most differing sizes at different stacking positions. The stacks to be strapped can be supplied and/or conveyed away again between the arms or transverse to them. Through the curvature and the course of the arms 11, the loop can be influenced in a specific manner while it is being brought into the strapping position.

In the illustrated embodiment, the grippers 12 each respectively consist of a plastic element (e.g., an elastic clip) with an essentially U-shaped opening, which serves to temporarily hold the strapping means 5. These plastic elements are each respectively driven by a steel string guided within the guide groove 13 (not illustrated in more detail). Underneath the work surface there is a driving device (not depicted in more detail) that serves to unroll and roll up the steel strings of each arm 11. The arrangement illustrated is characterized by the fact that the mass of the moving parts (gripper 12 and steel string, resp., loop of strapping tape) is very low and by the fact that only few parts have to be moved rapidly. The grippers 12 serve as driving devices for the strapping 5. Depending on the field of application, instead of the U-shaped opening depicted here, they can also comprise an opening with an O-shaped, slotted cross section, from which the means of strapping 5 can be pulled out laterally. Other designs are also feasible.

Figure 2:
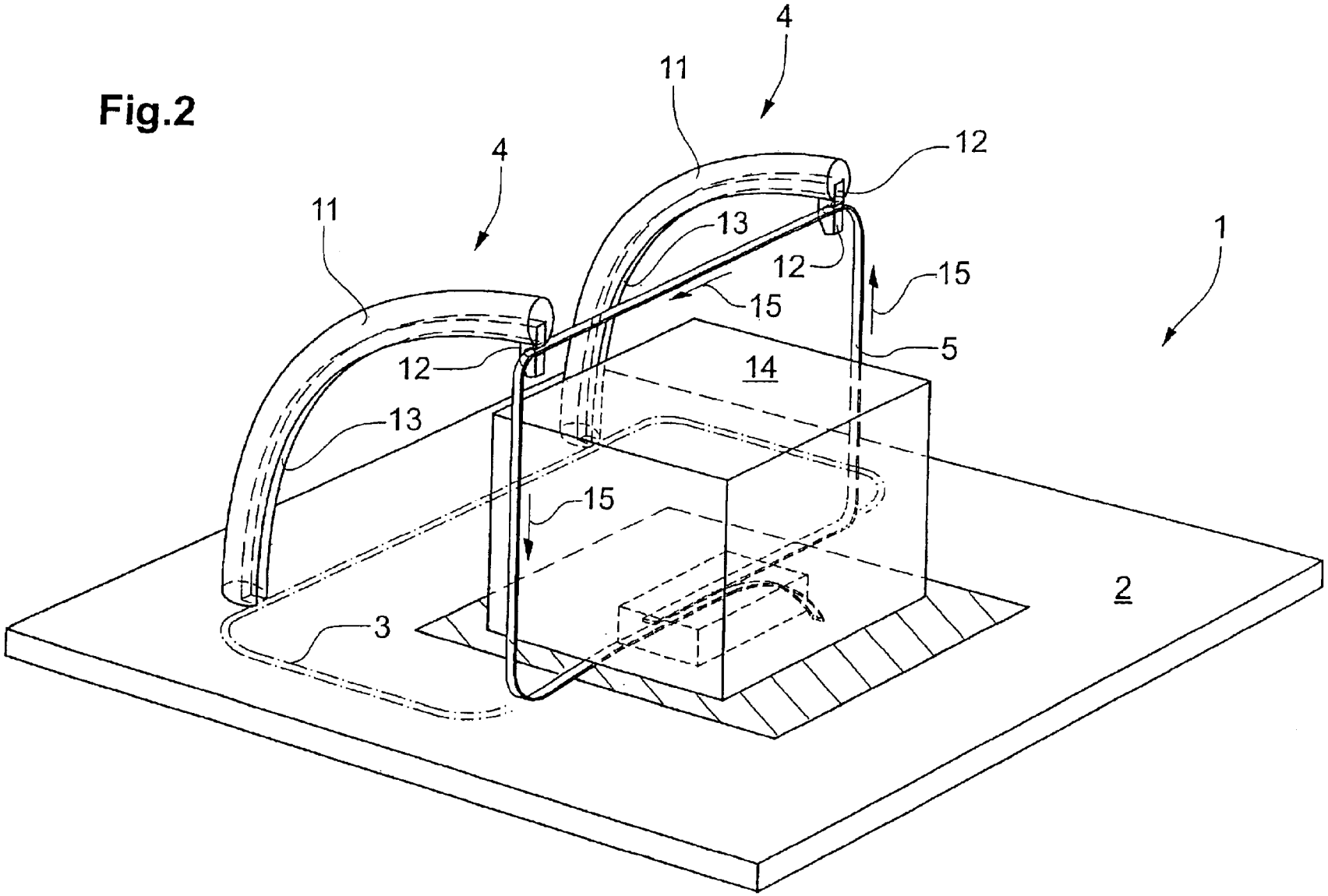
FIG. 2 is the device according to FIG. 1 with a stack to be strapped; and, FIG. 3 is the device in accordance with FIG. 1 with a strapped stack.

FIG. 2 in a strongly simplified and schematic manner illustrates the device in accordance with the invention 1 according to FIG. 1 with a stack to be strapped 14 on the work surface 2. This stack is depicted simplified as a cube-shaped object. The strapping tape 5 in the waiting position previously formed into a loop in the work surface 2 is located in a position raised upright by approximately 90° relative to the work surface 2 (stacking position), lateral to and above the stack 14 and at a certain distance from it. The loop of strapping tape has been raised into an upright position by the grippers and, more specifically, by movement of the grippers along the arms from the lower or starting position to the upper, raised position. Starting out from this raised upright position (stacking position), the strapping tape 5 is pulled together in the direction of the arrows 15, in that it is pulled backwards into the supply magazine located underneath the work surface 2 (not illustrated in more detail). In doing so, the strapping tape 5 is separated from the grippers 12. As a result of being pulled together, the tape 5 comes to lie tightly around the stack to be strapped 14 (refer to FIG. 3). The grippers 12 are positioned in dependence of the stacking position of the stack 14.

The grippers 12 can be moved either in synchronicity or asynchronously. As a result of this, it is possible to at least in part bring the loop into an upright position already while the stack 14 to be strapped is still in the course of being supplied.

Figure 3:
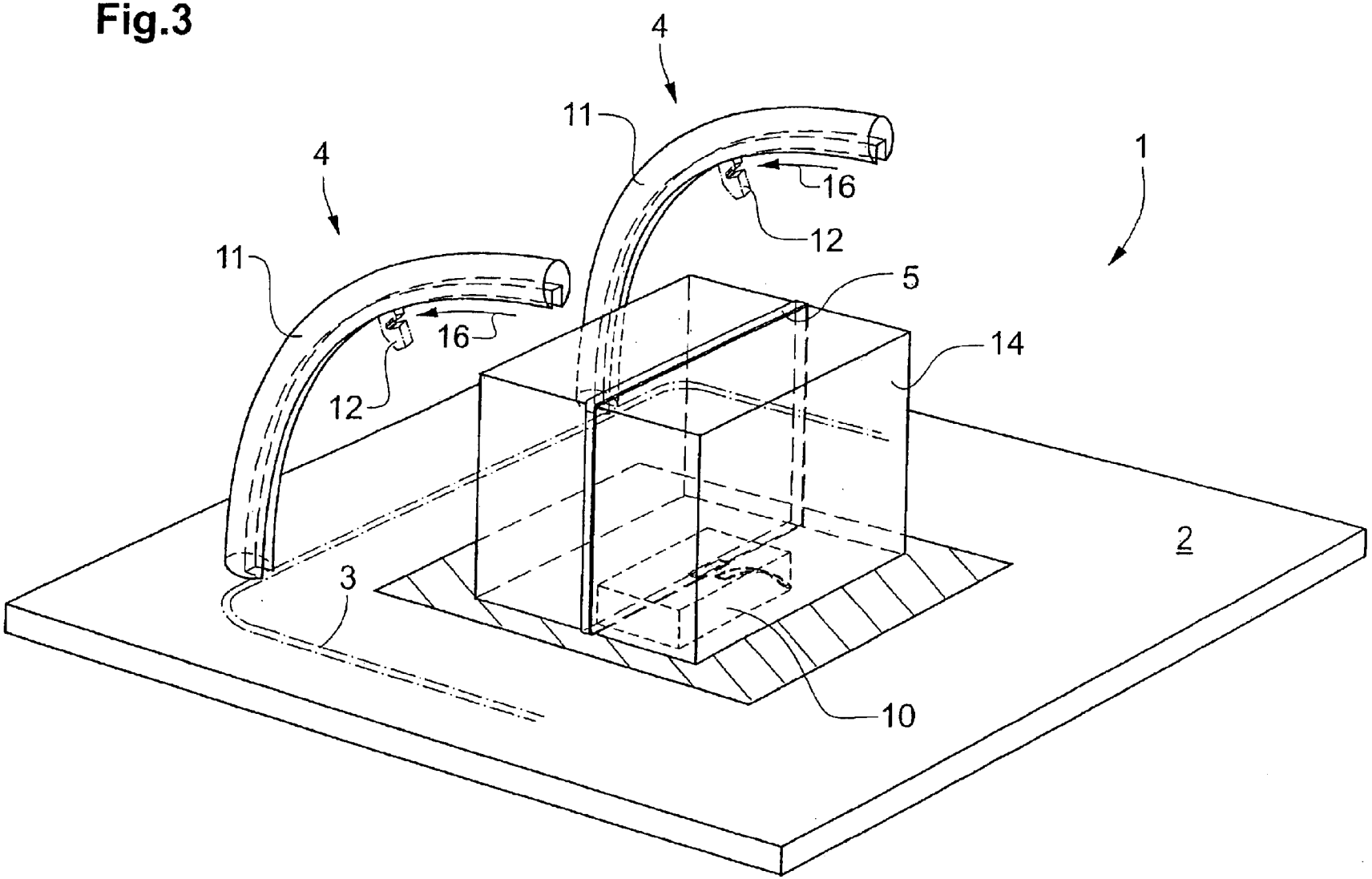

FIG. 3 illustrates the device in accordance with the FIGS. 1 and 2 with a strapped stack 14. The strapping tape 5 has been cut off from the remaining tape and closed to form a ring by means of the closing device 10. The grippers 12 are being moved back to their starting positions in the zone of the work surface 2 in the direction of the arrows 16. After the stack 14 has been conveyed away, the device is ready to strap a further stack of printed products. While the new stack (not depicted in more detail) is being supplied, in the loop guidance means the loop is already being prepared for its strapping.

For the sake of simplicity, the strapping of a stack has only been described in one direction. The invention, however, can also be designed in such a manner, that more than one strapping, e.g., in two directions are possible, inasmuch as correspondingly more loop movement means 4 are provided. In the zone of the work surface 2, for example, a rotary table can be arranged that makes possible an additional different alignment of the stack to be strapped.

For the specialist it is a matter of course that the invention is not solely limited to the embodiment illustrated, it being understood that numerous modifications and rearrangements of parts are within the scope of the present invention.

What is claimed is:

1. A strapping device (1) for strapping an object (14) with a strap (5), the strapping device (1) comprises:

guidance means (3) for guiding the strap (5), said guidance means (3) serving to form the strap (5) into a loop in a waiting position, independent of a position of an object to be strapped (14), wherein said guidance means is a groove arranged in the waiting position and into which the strap is able to be pushed; and, a loop movement means (4) for moving the loop (5), formed by the guidance means (3), from the waiting position to a stacking position around the object to be strapped (14), wherein said loop movement means comprises at least one arm projecting from the guidance means and at least one loop engaging means, which is arranged to be displaceable under control along the at least one arm and which serves as driving means for moving the loop of strap from the waiting position into the stacking position.

2. The strapping device (1) in accordance with claim 1, wherein the guidance means (3) is a groove (3) embedded in a work surface (2) and wherein the at least one loop engaging means is a gripper (12).

3. The strapping device (1) according to claim 2, wherein the at least one arm (11) is curved.

4. The strapping device (1) in accordance with claim 2, wherein the at least one arm (11) is arranged to be movable relative to the work surface (2).

5. The strapping device (1) according to claim 2, wherein the at least one gripper (12) comprises an opening with a substantially U-shaped or O-shaped, laterally slotted cross section, which serves for the temporarily holding and moving the strap (5) and which is adapted to release the strap (5) in the stacking position.

6. The strapping device (1) in accordance with claim 2, wherein in the interior of the arm (11), a movable, driven wire string is arranged, said string being connected with the at least one gripper (12) and being operable to drive said at least one gripper.

7. The strapping device (1) according to claim 2, wherein the strapping device (1) comprises a motor selected from the group consisting of: an electric motor, a compressed air motor, a hydraulic motor, a solenoid motor, and a piezo-electric motor, said motor driving the at least one gripper (12).

8. The strapping device (1) in accordance with claim 2, wherein the strapping device (1) consists of two arms (11), each of said two arms having one gripper arranged to be controllably movable along it.

9. The strapping device (1) according to claim 2, wherein the guidance means (3) extends essentially along the edges of a rectangle.

10. The strapping device (1) in accordance with claim 2, wherein the groove (3) is closed off by means of elastic elements.

11. A strapping assembly for strapping a stack with a strap, comprising:

a guide for guiding the strap to form a strap loop in a waiting position, the strap loop having a length sufficient to extend around the stack during strapping, wherein said guide is a groove arranged in the waiting position and into which the strap is able to be pushed; and, a loop moving device comprising loop engaging structures that are operable to engage the strap loop, to remove the strap loop at least partly from the guide, and to move the strap loop along a predetermined path from the waiting position into a stacking position in which the strap loop extends around the stack, wherein said loop moving device comprises at least one arm projecting from the guide and at least one loop engaging means, which is arranged to be displaceable under control along the at least one arm and which serves as drive for moving the loop of strap from the waiting position into the stacking position.

12. The strapping assembly according to claim 11, wherein the guide (3) is a groove (3) embedded in a work surface (2) and wherein the at least one loop engaging means is a gripper (12).

13. The strapping assembly according to claim 12, wherein the at least one arm (11) is curved.

14. The strapping assembly according to claim 12, wherein the at least one arm (11) is arranged to be movable relative to the work surface (2).

15. The strapping assembly according to claim 12, wherein the at least one gripper (12) comprises an opening with a substantially U-shaped or O-shaped, laterally slotted cross section, which serves for the temporarily holding and moving the strap (5) and which is adapted to release the strap (5) in the stacking position.

16. The strapping assembly according to claim 12, wherein in an interior of the arm (11), a movable, driven wire string is arranged, said string being connected with the at least one gripper (12) and being operable to drive said at least one gripper.

17. The strapping assembly according to claim 12, further comprising a motor selected from the group consisting of: an electric motor, a compressed air motor, a hydraulic motor, a solenoid motor, and a piezo-electric motor, said motor driving the at least one gripper (12).

18. The strapping assembly according to claim 12, further comprising two arms (11), each of said two arms having one gripper arranged to be controllably movable along it.

19. The strapping assembly according to claim 12, wherein the guide extends essentially along the edges of a rectangle.

20. The strapping assembly according to claim 12, wherein the groove (3) is closed off by means of elastic elements.

* * * * *